US008395886B2

(12) United States Patent
Butcher et al.

(10) Patent No.: US 8,395,886 B2
(45) Date of Patent: Mar. 12, 2013

(54) RANGE TOP SUPPORT WITH INTEGRAL POSITIONING CLIPS

(75) Inventors: Joel Butcher, Clarksville, TN (US); Derek Hughes, White Bluff, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 1293 days.

(21) Appl. No.: 12/147,609

(22) Filed: Jun. 27, 2008

(65) Prior Publication Data

US 2009/0323261 A1 Dec. 31, 2009

(51) Int. Cl.
*H05K 7/14* (2006.01)
*B23P 21/00* (2006.01)
*F24C 7/00* (2006.01)

(52) U.S. Cl. ..... 361/679.01; 361/679.02; 361/724; 29/513; 29/521; 126/50; 126/273 R

(58) Field of Classification Search ..... 361/369.01, 361/679.02, 724; 29/513, 521, 409.09, 407.1; 126/50, 273 R, 55, 37 R, 39 B, 19 R, 217, 126/218; 108/28–30; 211/4, 27, 41.1, 119.005, 211/124; 248/346.5, 689, 121, 200
See application file for complete search history.

(56) References Cited

U.S. PATENT DOCUMENTS

| | | | | |
|---|---|---|---|---|
| 3,402,281 | A * | 9/1968 | Vonderhaar | 219/408 |
| 4,032,750 | A * | 6/1977 | Hurko | 219/455.12 |
| 4,245,615 | A * | 1/1981 | Moss | 126/273 R |
| 7,455,278 | B2 * | 11/2008 | Hsu | 248/675 |
| 7,789,081 | B2 * | 9/2010 | Raby et al. | 126/273 R |
| 2005/0179347 | A1 * | 8/2005 | Kim et al. | 312/228 |
| 2005/0287852 | A1 * | 12/2005 | Sugawara et al. | 439/135 |
| 2006/0027561 | A1 * | 2/2006 | Lee | 219/460.1 |
| 2007/0236877 | A1 * | 10/2007 | Huang | 361/683 |

* cited by examiner

*Primary Examiner* — Linda Dvorak
*Assistant Examiner* — Amanda L Scott
(74) *Attorney, Agent, or Firm* — Pearne & Gordon LLP

(57) ABSTRACT

An assembly for aligning a top frame with respect to a top portion of a chassis in a home appliance is provided. The assembly includes a top frame and a support plate. The support plate is configured to be secured to a chassis and includes a first set and a second set of protrusions. The first set of protrusions is configured to engage the top frame to align the top frame in fore and aft directions. The second set of protrusions is configured to engage the top frame to align the top frame in transverse directions. A method for aligning a top frame with respect to a top portion of a chassis in a home appliance is also provided.

18 Claims, 8 Drawing Sheets

RANGE TOP SUPPORT WITH INTEGRAL POSITIONING CLIPS

FIELD OF THE INVENTION

The present invention relates generally to a support plate for a home appliance, and more particularly, to a support plate for mounting a top frame over a chassis in the home appliance.

BACKGROUND OF THE INVENTION

Electrical appliances are often assembled by fastening together a plurality of distinct parts. Precision of assembly is required to achieve consistency in aesthetics or quality, and errors in assembly may result in disassembly of an otherwise finished product causing reduced productivity and loss of time. Although these problems may be prevented to a certain extent with increased attention, the frequency of error may still need to be reduced and certain errors may go undetected despite increased attention. Thus, there is a need for additional ways to improve precision of assembly and to reduce the likelihood of error in the assembly of electrical appliances.

BRIEF SUMMARY OF THE INVENTION

Accordingly, it is an aspect of the present invention to obviate problems and shortcomings of conventional assembly of electrical appliances.

To achieve the foregoing and other aspects and in accordance with the present invention, a home appliance including a chassis, a top frame and a support plate is provided. The chassis includes a top portion and the top frame is configured to be mounted on the top portion. The support plate is configured to engage the top frame and include two longitudinal ends. Each of the ends including a first protrusion for aligning the top frame in fore and aft directions and a second protrusion for aligning the top frame in transverse directions over the top portion. The support plate engages the top frame by the first and second protrusions.

To achieve further aspects and in accordance with the present invention, a method of assembling a chassis and a top frame using a support plate in a home appliance is provided. The method comprises the step of securing the support plate to a top portion of the chassis. The support plate is configured with a first set of protrusions and a second set of protrusions. The method further comprises the step of mounting the top frame to engage the support plate so that the top frame is aligned with respect to the chassis in fore and aft directions and transverse directions. The first set of protrusions is configured to align the top frame in fore and aft directions. The second set of protrusions configured to align the top frame in transverse directions. The method further comprises the step of securing the top frame to the top portion.

To achieve still further aspects and in accordance with the present invention, an assembly for aligning a top frame with respect to a top portion of a chassis in a home appliance is provided. The assembly includes a top frame and a support plate. The support plate is configured to be secured to a chassis and includes a first set and a second set of protrusions. The first set of protrusions is configured to engage the top frame to align the top frame in fore and aft directions. The second set of protrusions is configured to engage the top frame to align the top frame in transverse directions.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1A:
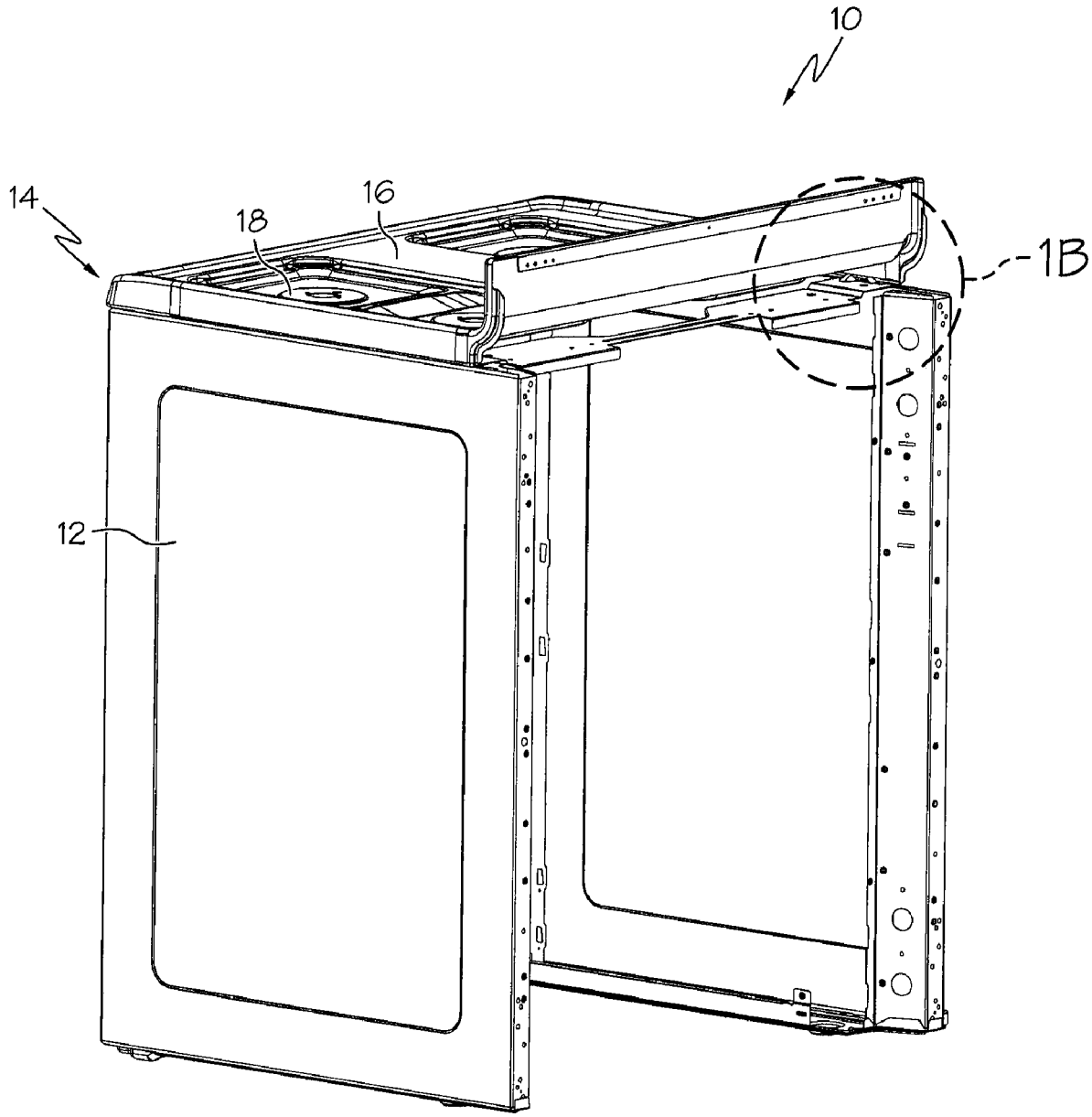
FIG. 1A is a view of a home appliance implementing the present invention.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices.

FIG. 1A shows a home appliance 10 in which the invention can be implemented and the example embodiment of the home appliance is a stove. Parts of the home appliance 10 have been omitted for clarity of illustration. The present invention is applicable whether the stove is of a gas type or an electric type. The home appliance 10 may include a chassis 12 which may house an enclosed compartment for cooking such as an oven and various other components necessary to generate heat for cooking.

Figure 2A:
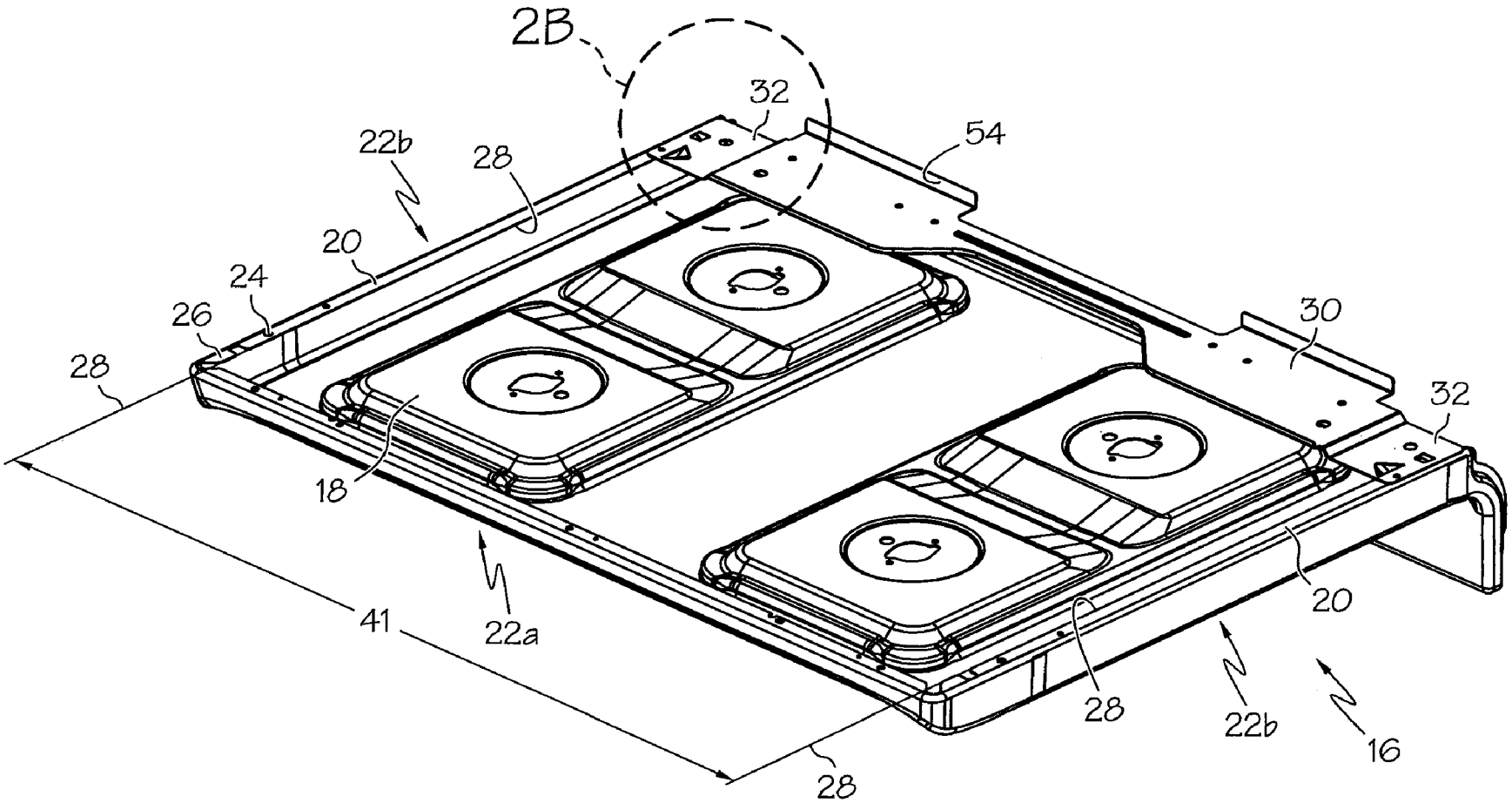
FIG. 2A is a perspective bottom view of the top frame and the support plate.

A top portion 14 of the chassis 12 may provide an area above which a cooking surface may be formed. A perimeter of the cooking surface may be substantially defined by a top frame 16 which may be configured to be mounted on the top portion 14 of the chassis 12. FIG. 2A shows a bottom view of the top frame 16 detached from the top portion 14. The top frame 16 may provide mounting areas 18 for one or more heating elements such as gas burners or electric coils.

In order to mount the top frame 16 to the top portion 14 of the chassis 12, a bottom part of the top frame 16 may include flanges 20 along edges of the top frame 16 that may be inwardly oriented. In this embodiment, the flanges 20 are provided at a front edge 22*a* and lateral edges 22*b* of the top frame 16. The flanges 20 may include apertures 24 for fastening means such as screws or dented portions 26 provided to help mount the top frame 16 to the top portion 14 of the chassis 12. The flanges 20 at the lateral edges 22*b* are a first predetermined distance 41 apart from one another, which is determined by the distance between innermost parts 28 of the flanges 20.

Figure 1B:
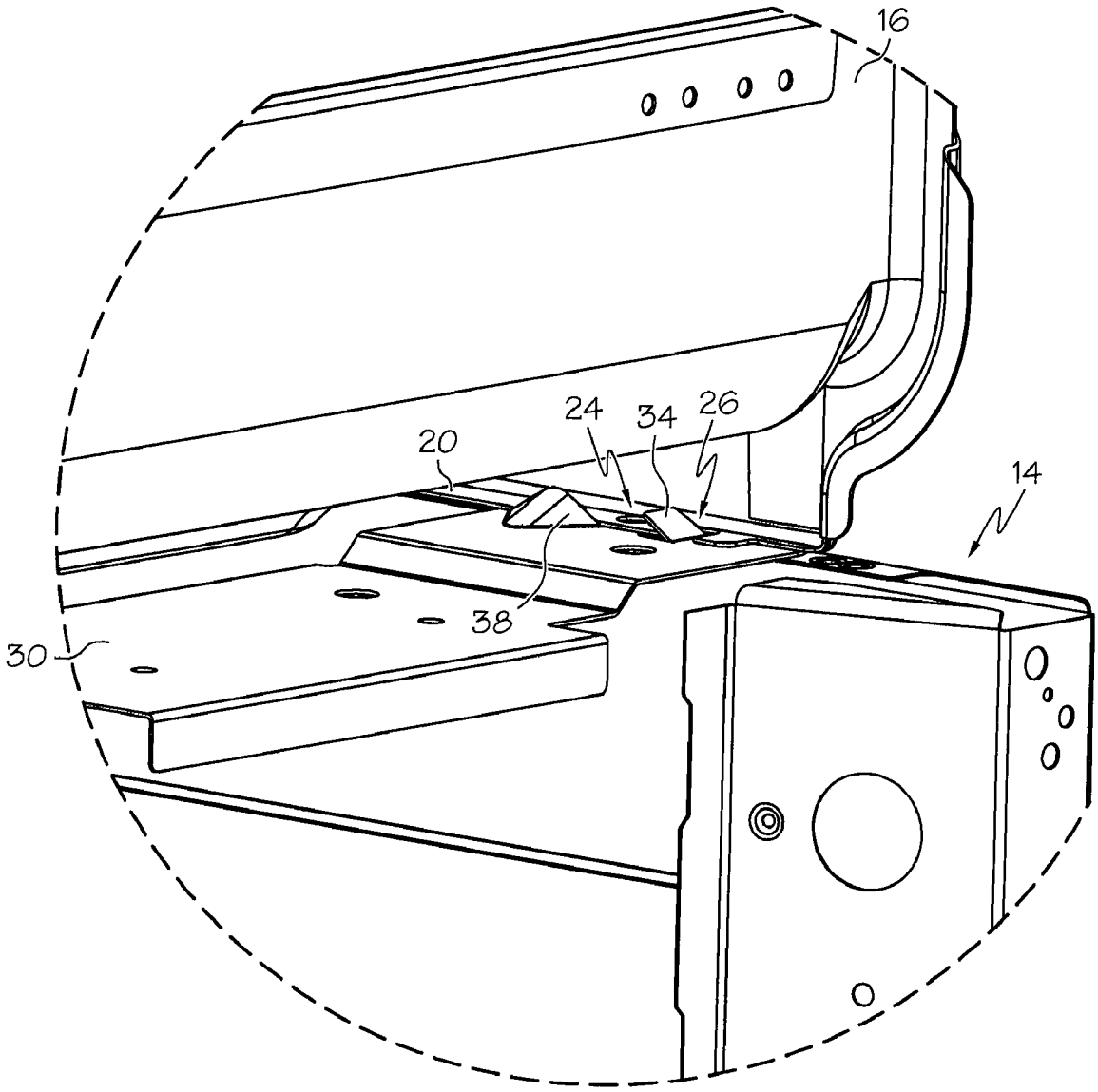
FIG. 1B is a zoomed-in view of FIG. 1A showing a support plate mounted between a chassis and a top frame.
Figure 2B:
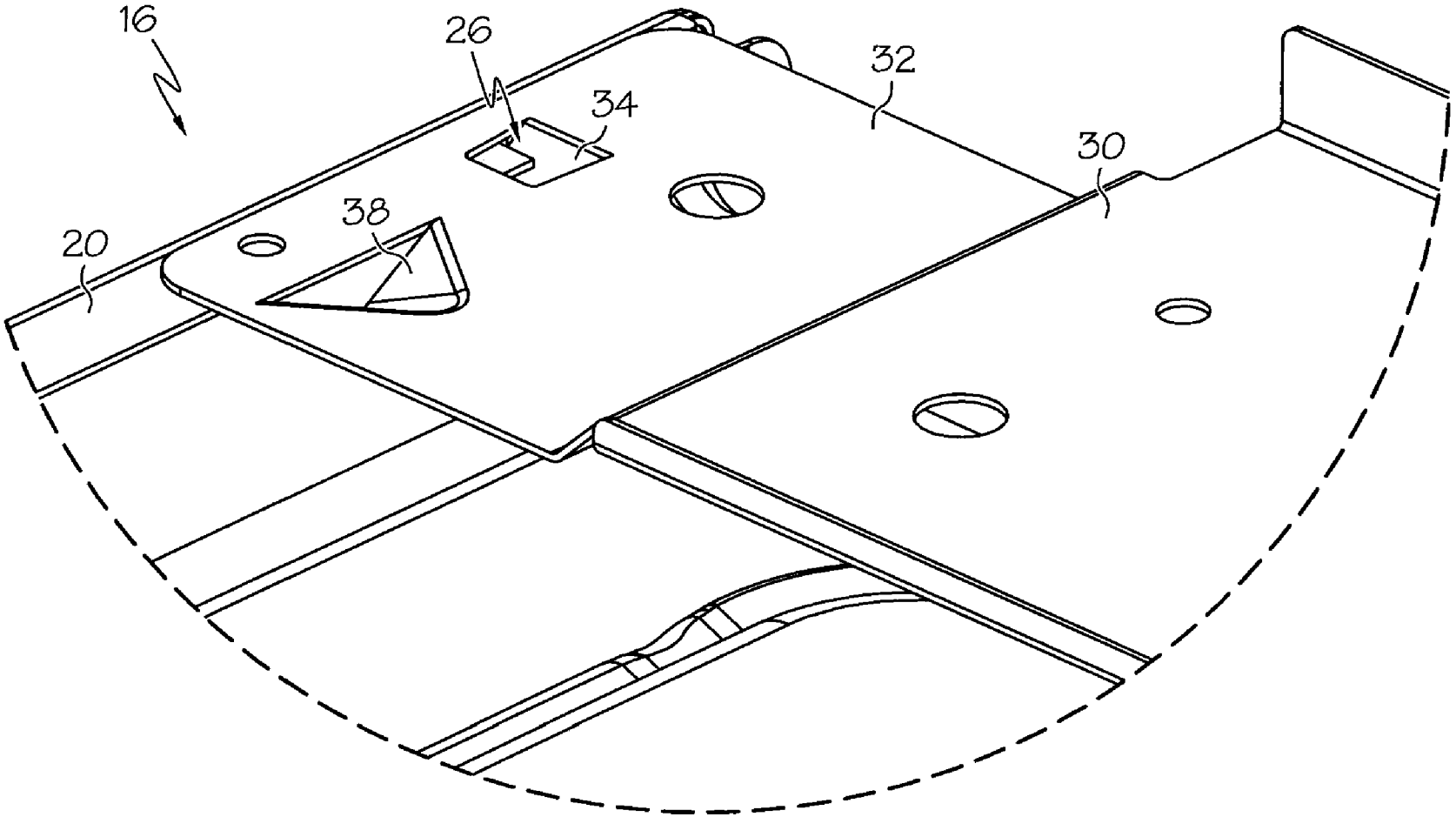
FIG. 2B is a zoomed-in view of a portion of FIG. 2A showing a longitudinal end of the support plate engaging a flange of the support plate.
Figure 3:
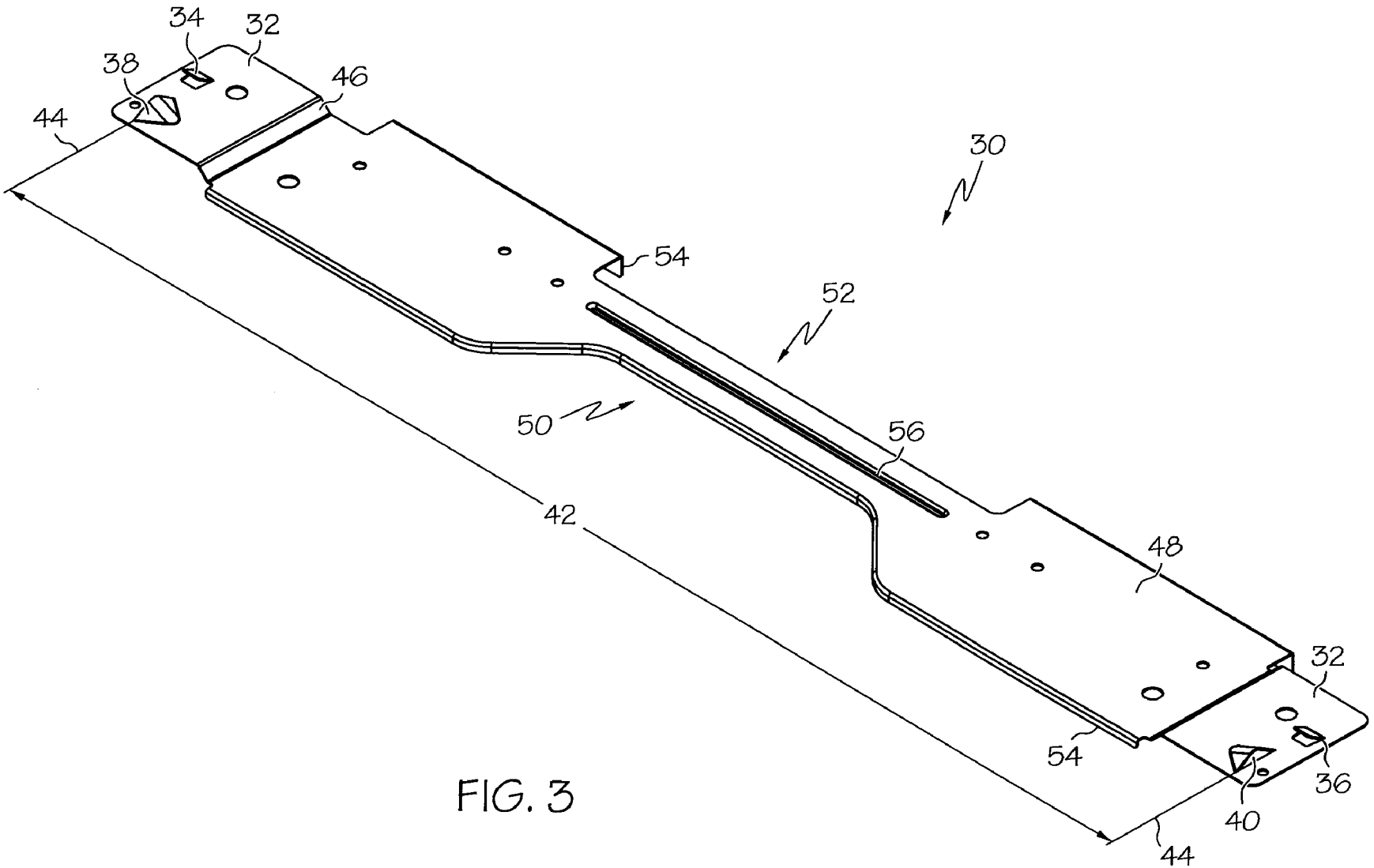
FIG. 3 is a perspective top view of the support plate.

FIG. 3 shows an elongate support plate 30 which may be secured to the top portion 14 of the chassis 12 and above which the top frame 16 may be mounted. The support plate 30 may be symmetrical about a center axis that cuts through the elongate shape. The support plate 30 may be dimensioned to extend substantially across the top portion 14 of the chassis 12 in any direction such as length, width or diagonal. As shown in FIG. 1B, longitudinal ends 32 of the support plate 30 may be configured with protrusions that engage or abut portions of the top frame 16 to align the top frame 16 with respect to the top portion 14. FIG. 2B is a close-up view of a portion of FIG.

2A and shows from a different perspective of the support plate 30 engaged by the top frame 16. A first protrusion 34 may be a rectangle that is oriented to project upwardly and toward a front of the home appliance 10 at an angle about the support plate 30. The first protrusion 34 may have shapes other than a rectangle and need not project in a straight manner from the support plate 30. Thus, the first protrusion 34 may have curved or straight bends. Moreover, the angle 36 of the first protrusion 34 with respect to the support plate 30 may be acute pointing toward a front of the home appliance 10, obtuse pointing toward a rear of the home appliance 10, or perpendicular. The first protrusion 34 may be configured to catch one of the apertures 24 or dented portions 26 formed on the flange 20 of the top frame 16 as the top frame 16 is placed on the top portion 14 of the chassis 12 before being completely fastened with means such as screws. Thus, the first protrusions 34 may be present on the longitudinal ends 32 of the support plate 30 and, as the dented portions 26 are caught by the first protrusions 34 during mounting, the top frame 16 is brought to a halt and will be aligned in fore and aft directions on the top portion 14 of the chassis 12 with consistency. Also, the acute angle configuration of the first protrusion 34 tends to keep a rear of the top frame 16 down and maintains the top frame 16 close to the top portion 14 thereby facilitating fastening between the top frame 16 and the top portion 14.

A second protrusion 38 may project so as to form a tetrahedron with a side face 40 that is open and substantially perpendicular about the support plate 30. The second protrusion 38 may be formed on each of the longitudinal ends 32 of the support plate 30 and may be oriented such that the side faces 40 of the tetrahedrons are a second predetermined distance 42 apart. The second predetermined distance 42 is the distance between outermost parts 44 of the second protrusions 38. In this embodiment, the second predetermined distance 42 is from one side face 40 to another side face 40, and may be equal to, or slightly more or less than, the first predetermined distance 41. As a result, the innermost parts 28 of the flanges 20 abut or engage the outermost parts 44 of the second protrusions 38 and the top frame 16 is centered or aligned in transverse directions with respect to the top portion 14 of the chassis 12 as the top frame 16 is placed on the top portion 14.

Figure 4A:
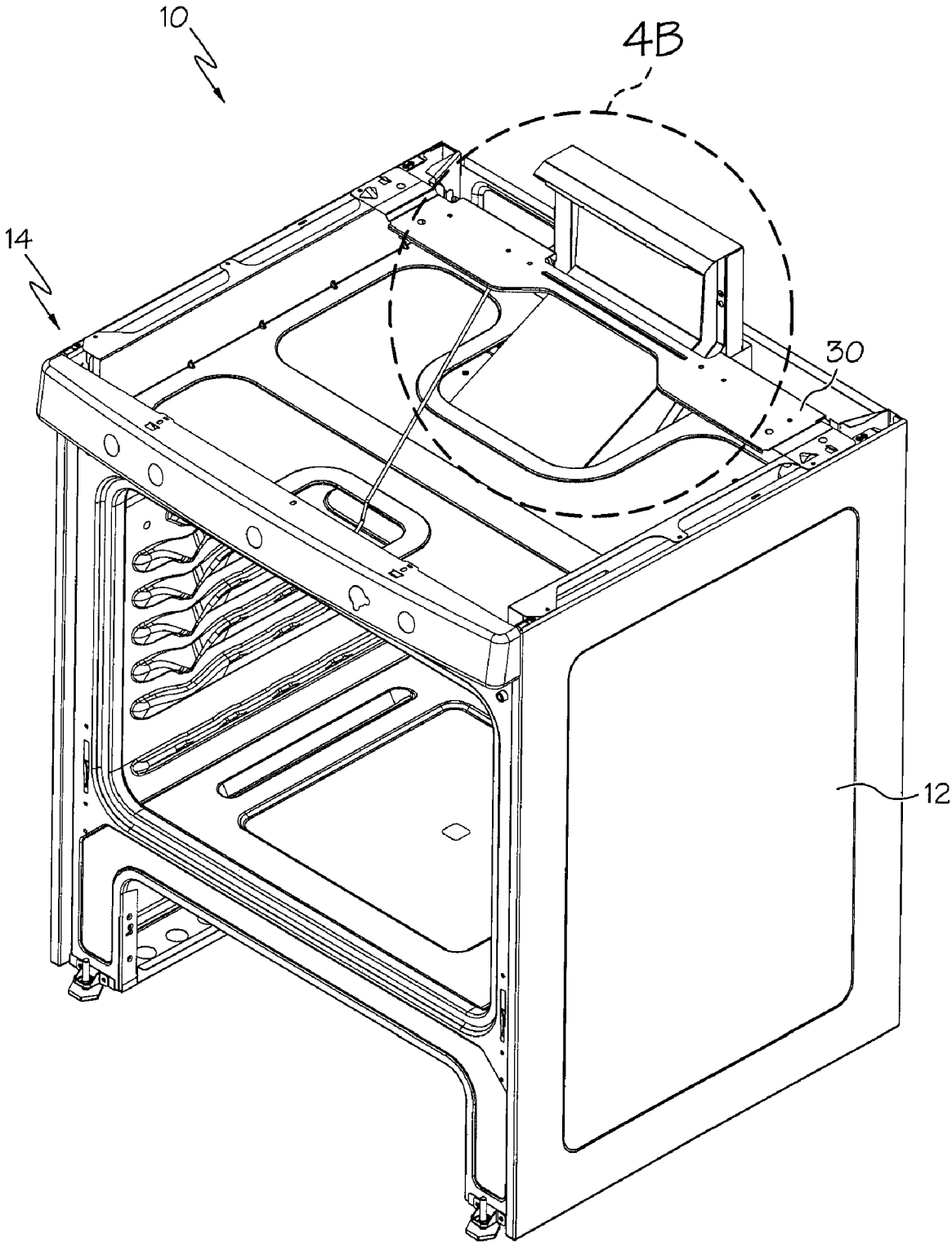
FIG. 4A is a view of the support plate mounted on a gas stove.
Figure 4B:
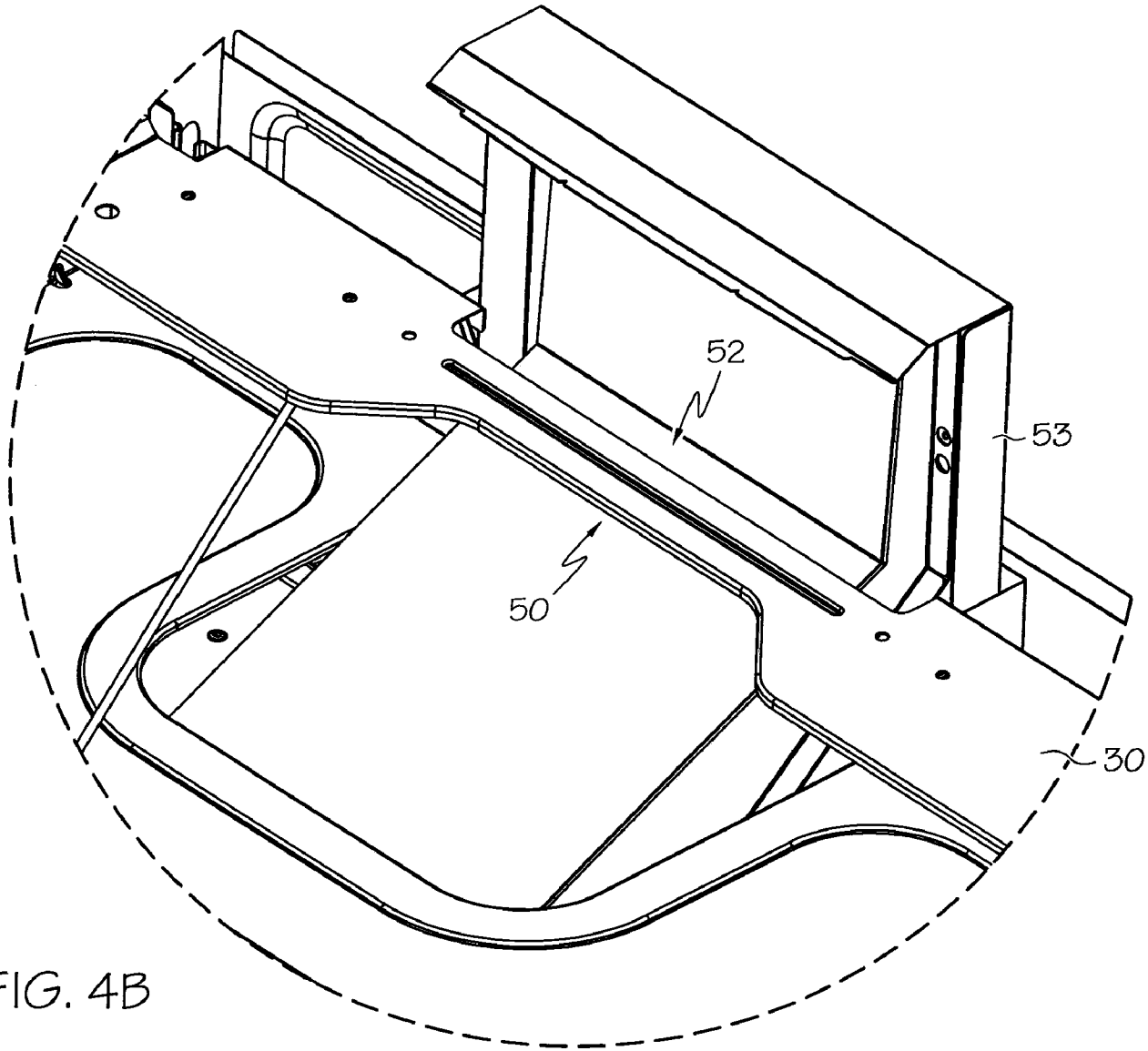
FIG. 4B is a zoomed-in view of a portion of FIG. 4A showing recessed portions of the support plate.
Figure 5:
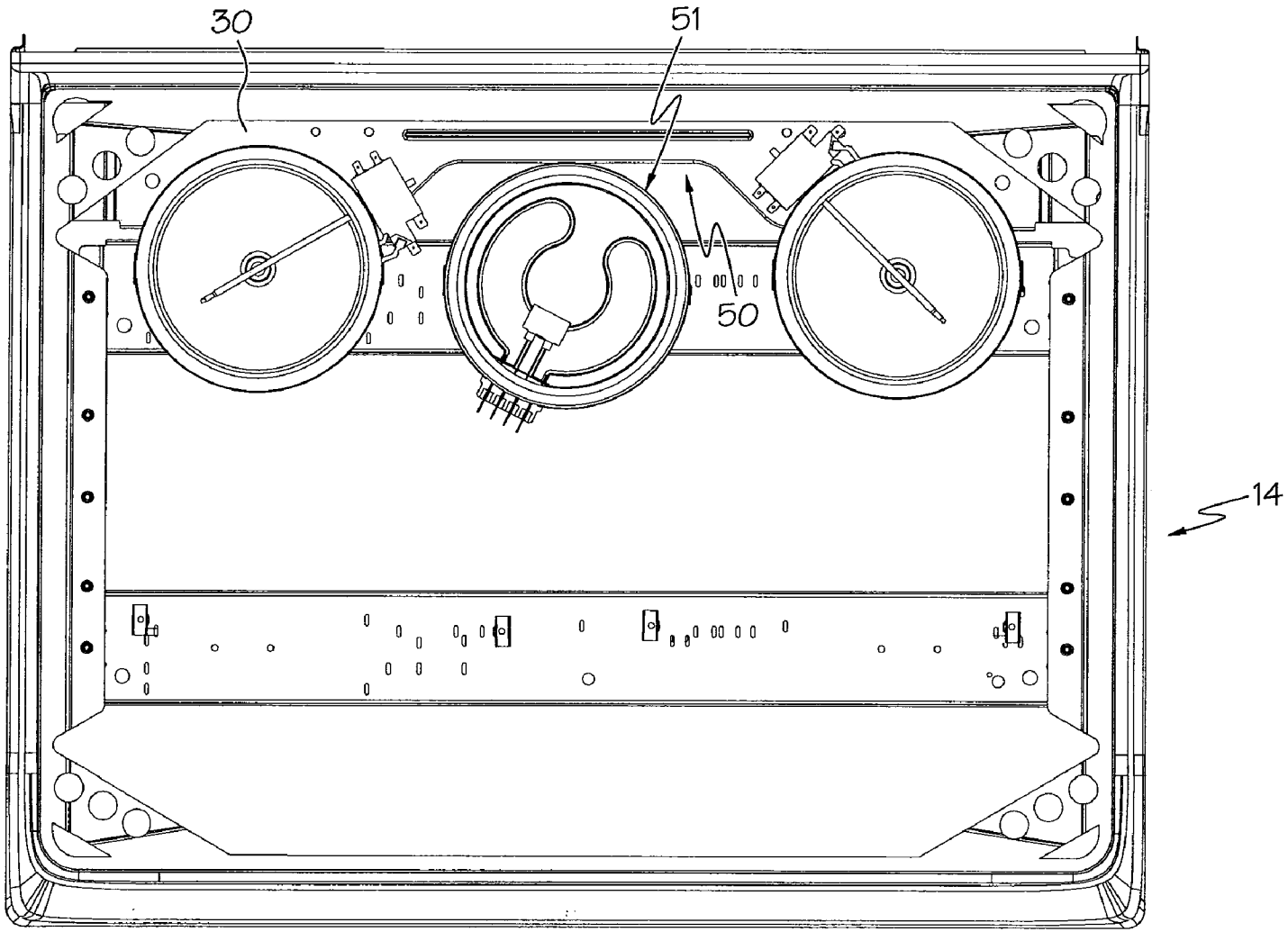
FIG. 5 is a top view of the support plate mounted on an electric stove.

Although the support plate 30 in this embodiment is substantially flat, rectangular and symmetrical in FIG. 3, its shape may be modified with alterations such as a stepped portion 46 to provide a middle portion 48 with a different elevation or a recessed portion to clear or avoid a neighboring structure. As shown in FIG. 5, the support plate 30 may be configured with a first recessed portion 50 at the front to accommodate or avoid a first neighboring structure 51 such as a heating element present on the cooking surface. Additionally, as shown in FIG. 4A-4B, the support plate may be configured with a second recessed portion 52 at the rear to accommodate or avoid a second neighboring structure 53 which, for example, may be a gas channeling element such as a gas flue box which may be present at the rear of a gas stove. Thus, the support plate 30 may be configured to be compatible with various types of home appliances. Moreover, edges of the support plate 30, such as at the front or the rear, may be configured with bracketed portions 54 for various purposes such as to engage neighboring structures or to provide blunt edges for safe manual gripping. The middle portion 48 of the support plate 30 may be provided with an elongate bead portion 56 to prevent bending and keep the middle portion 48 level.

The support plate 30 may be made of rigid material such as metal, and the protrusions, the apertures, the alterations of the support plate 30 may be formed by molding, punching, cutting and bending, or other machining means.

A benefit of the present invention is that alignment of the top frame 16 with respect to the top portion 14 of the chassis 12 occurs as the top frame 16 is mounted or placed on the top portion 14 due to the interaction between the flanges 20 of the top frame 16 and the first and second protrusions 34, 38. As a result, misalignment of the parts becomes less of a concern and fastening of the top frame 16 to the top portion 14 is facilitated. Although FIG. 2A shows the support plate 30 on the top frame 16, the support plate 30 will generally be secured to the top portion 14 first and then the top frame 16 is mounted above the support plate 30.

Although this embodiment of the home appliance is a stove, the present invention is applicable to other cooking appliances or washing appliances that have a main body such as the chassis 12 and a part attached to the main body such as the top frame 16 discussed above.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A home appliance including:

a chassis including a top portion;

a top frame configured to be mounted on the top portion; and a support plate configured to engage the top frame and including two longitudinal ends, each of the ends including a first protrusion for aligning the top frame in fore and aft directions and a second protrusion for aligning the top frame in transverse directions over the top portion, the support plate engaging the top frame by the first and second protrusions, wherein the top frame includes an inwardly oriented flange at lateral edges, the top frame engaging the first and second protrusions by the flange.

2. The home appliance according to claim 1, the support plate secured to the top portion so as to extend substantially across the top portion in transverse directions.

3. The home appliance according to claim 1, the first protrusion projecting at an angle about the support plate, the flange including a dented portion that the first protrusion is configured to engage thereby bringing the top frame to a halt during mounting.

4. The home appliance according to claim 3, the first protrusion projecting at an acute angle about the support plate so as to keep the top frame close to the top portion after the dented portion is engaged by the first protrusion.

5. The home appliance according to claim 1, outermost parts of the second protrusions of the support plate being a first predetermined distance apart from one another, innermost parts of the flanges of the top frame located a second predetermined distance apart, which is substantially equal to the first predetermined distance, so as to center the top frame in transverse directions when the top frame is mounted on the top portion.

6. The home appliance according to claim 5, the second protrusions having a tetrahedron shape with a perpendicular side face, the distance between the perpendicular side faces being the first predetermined distance.

7. A home appliance including:

a chassis including a top portion;

a top frame configured to be mounted on the top portion;

a support plate configured to engage the top frame and including two longitudinal ends, each of the ends including a first protrusion for aligning the top frame in fore and aft directions and a second protrusion for aligning the top frame in transverse directions over the top portion, the support plate engaging the top frame by the first and second protrusions; and, a cooking surface formed above the top portion of the chassis.

8. A home appliance including:

a chassis including a top portion;

a top frame configured to be mounted on the top portion; and a support plate configured to engage the top frame and including two longitudinal ends, each of the ends including a first protrusion for aligning the top frame in fore and aft directions and a second protrusion for aligning the top frame in transverse directions over the top portion, the support plate engaging the top frame by the first and second protrusions, a central portion of the support plate being recessed at a front to provide clearance for a heating element, wherein the home appliance is an electric stove.

9. A home appliance including:

a chassis including a top portion;

a top frame configured to be mounted on the top portion; and a support plate configured to engage the top frame and including two longitudinal ends, each of the ends including a first protrusion for aligning the top frame in fore and aft directions and a second protrusion for aligning the top frame in transverse directions over the top portion, the support plate engaging the top frame by the first and second protrusions, a central portion of the support plate being recessed at a rear to provide clearance for a gas flue box, wherein the home appliance is a gas stove.

10. A method of assembling a chassis and a top frame using a support plate in a home appliance, comprising the steps of:

securing the support plate to a top portion of the chassis, the support plate configured with a first set of protrusions and a second set of protrusions;

mounting the top frame to engage the support plate so that the top frame is aligned with respect to the chassis in fore and aft directions and transverse directions, the first set of protrusions configured to align the top frame in fore and aft directions, the second set of protrusions configured to align the top frame in transverse directions, and securing the top frame to the top portion.

11. The method according to claim 10, further comprising the step of:

securing the support plate to the top portion of the chassis so that the support plate extends substantially across the top portion.

12. The method according to claim 10, further comprising the step of:

providing inwardly oriented flanges along lateral edges of the top frame, the flange provided with dented portions configured to be caught by the first set of protrusions, outermost parts of the second set of protrusions being a predetermined distance apart, a distance between innermost parts of the flanges being substantially equal to the predetermined distance so that the second set of protrusions centers the top frame on the top portion.

13. The method according to claim 12, further comprising the step of:

configuring the first set of protrusions to project at an acute angle about the support plate so that the top frame is kept close to the top portion as the first set of protrusions engage the dented portions.

14. The method according to claim 10, further comprising the step of:

providing the support plate with a recessed portion configured to provide clearance for a neighboring structure.

15. An assembly for aligning a top frame with respect to a top portion of a chassis in a home appliance, the assembly including a top frame and a support plate, the support plate configured to be secured to a chassis and including a first set and a second set of protrusions, the first set of protrusions configured to engage the top frame to align the top frame in fore and aft directions, the second set of protrusions configured to engage the top frame to align the top frame in transverse directions, wherein the first set of protrusions is of a different configuration than the second set of protrusions.

16. The assembly according to claim 15, the top frame including inwardly oriented flanges at lateral edges, the flanges including dented portions configured to be engaged by the first set of protrusions, innermost parts of the flanges being a first predetermined distance apart, outermost parts of the second set of protrusions being a second predetermined distance apart which is substantially equal to the first predetermined distance.

17. The assembly according to claim 16, the first protrusions projecting at an acute angle about the support plate so as to keep the top frame close to the top portion as the first set of projections engages the dented portions.

18. The assembly according to claim 15, the support plate configured with a first recessed portion at a front to provide clearance for a heating element where the support plate is mounted on an electric stove, and the support plate further configured with a second recessed portion at a rear to provide clearance for a gas flue box where the support plate is mounted on a gas stove.

* * * * *